United States Patent [19]

Drueck, Jr.

[11] Patent Number: 4,619,426

[45] Date of Patent: Oct. 28, 1986

[54] SELF-ERECTING HOLLOW STRUCTURE

[76] Inventor: Fred Drueck, Jr., 4941 W. Henderson St., Chicago, Ill. 60641

[21] Appl. No.: 736,854

[22] Filed: May 22, 1985

[51] Int. Cl.[4] ..... B65D 5/08; B65D 5/36; B65D 5/52

[52] U.S. Cl. ..... 248/174; 248/152; 206/805; 206/45.27

[58] Field of Search ..... 248/174, 152; 206/805, 206/482, 483, 486, 45.27; 229/16 D

[56] References Cited

U.S. PATENT DOCUMENTS

| | | | |
|---|---|---|---|
| 1,269,621 | 6/1918 | Lewinson | 206/45.27 |
| 2,851,804 | 9/1958 | Roach | 206/805 |
| 3,300,166 | 1/1967 | Wojciechowski | 248/174 |
| 4,285,150 | 8/1981 | Richardson et al. | 229/16 D X |
| 4,335,830 | 6/1982 | Garganese | 206/805 X |

FOREIGN PATENT DOCUMENTS

| | | | |
|---|---|---|---|
| 1254983 | 1/1961 | France | 248/174 |
| 603388 | 6/1948 | United Kingdom | 206/805 |

*Primary Examiner*—J. Franklin Foss
*Assistant Examiner*—Karen J. Chotkowski
*Attorney, Agent, or Firm*—Robt. E. Knechtel; Basil E. Demeur

[57] ABSTRACT

A collapsible, self-erecting hollow structure which is formed from an integral blank of paperboard which is cut and scored to form a plurality of side and end walls which when erected form the hollow structure. Each of the plurality of side and end walls are hingedly connected along one edge thereof with at least one other wall. The hollow structure also has at least two flaps, each of which is hingedly connected along one edge thereof with at least one of the plurality of side walls. These flaps each is cut and scored to form an attachment and further is folded and affixed to one of the plurality of end walls on the side thereof which is interior of the erected hollow structure. An elastic means such as a rubber band is secured under tension to the attachments and normally pulls the two end walls to which the flaps are hingedly connected toward one another and thereby erecting said hollow structure. The hollow structure may also have affixed to it a copy extender. In this case, one of the end walls has a slot formed in it, and a hook portion is formed on the copy extender and proportioned to extend through the slot in the end wall. The elastic means is secured under tension to one of the attachments and to the hook portion. When the hollow structure is erected, the copy extender is positioned substantially perpendicular to the end wall by the action of the elastic means. Alternatively, the copy extender can be integrally formed with the hollow structure such that it is simultaneously erected with the erection of said hollow structure.

7 Claims, 10 Drawing Figures

SELF-ERECTING HOLLOW STRUCTURE

BACKGROUND OF THE INVENTION

This invention relates to collapsible, self-erecting hollow structures. Such structures may be used in advertising, or as toys.

Collapsible, self-erecting structures are disclosed in U.S. Pat. Nos. 822,841; 888,774; and 3,234,682. The structures disclosed in these patents, in each instance, can be folded or collapsed to a flat configuration and subsequently erected to a hollow structure, usually by means of an elastic band. The elastic bands in many cases are secured such that they are readily seen by an observer, thus detracting from the appearance of the structure. In other cases, the structures are wrapped with a covering to conceal the elastic bands and the construction thereof, all of which adds to the cost of manufacturing them.

The collapsible, self-erecting structures of the present invention overcome these deficiences of the prior structures disclosed in the above-mentioned patents, and provide substantial improvements in the construction and operation of such structures. Furthermore, the collapsible, self-erecting structures can include extenders which provide a new and unique feature which make them ideal for promoting and advertising a product or service. Further still, the collapsible, self-erecting structures can be packaged and shipped in a unique package which, when opened, permits them to automatically self-erect to thereby add to the attractiveness and uniqueness of them in advertising or otherwise conveying a message to the receiver thereof.

Accordingly, it is an object of the present invention to provide an improved collapsible, self-erecting hollow structure.

A further object is to provide a collapsible, self-erecting hollow structure having a copy extender affixed to or integrally formed therewith.

The above as well as other objects not specifically mentioned will become apparent from the description below, when read in conjunction with the accompanying drawings.

DESCRIPTION OF THE PREFERRED EMBODIMENT

Figure 1:
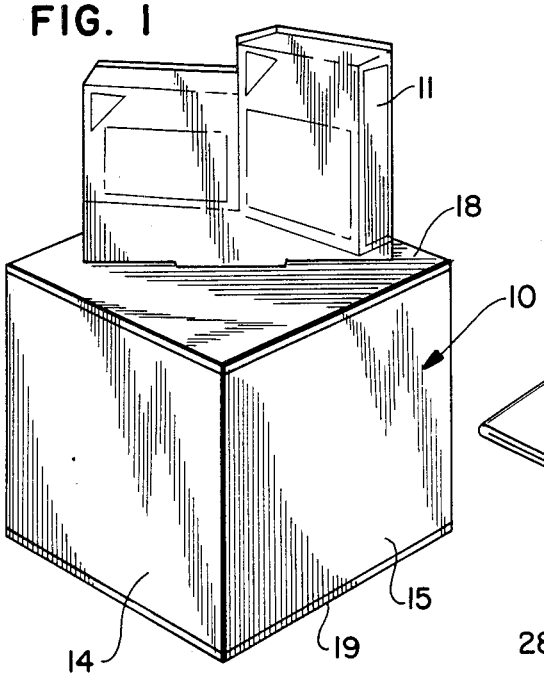
FIG. 1 is a perspective view of a hollow structure in the form of a cube in accordance with one embodiment of the invention.

Referring now to the drawings, in FIGS. 1–4 there is illustrated a self-erecting hollow structure which is in the form of a cube 10. As illustrated, the cube 10 also has a copy extender 11 affixed to it, as more specifically described below. The cube 10 is formed from the integral blank of paperboard 12 illustrated in FIG. 4 and includes four side walls 14–17 and two end walls 18, 19. Each of the walls 14–19 is hingedly connected along at least one of its edges to at least one of the other walls. The hinge connections between these walls are formed by the respective ones of the score lines 20–24. The cube 10 also has at least two flaps 26, 28, each of which is hingedly connected along one edge thereof with at least one of the side walls 14–19. As illustrated, the flap 26 is hingedly connected by the score line 29 to the side wall 16, and the flap 28 is hingedly connected by the score line 30 to the side wall 15. The flaps 26, 28 each is cut and scored to form an attachment 36, 38, for fixing these flaps 26, 28 to one of the end walls 18, 19 as more particularly described below.

Figure 2:
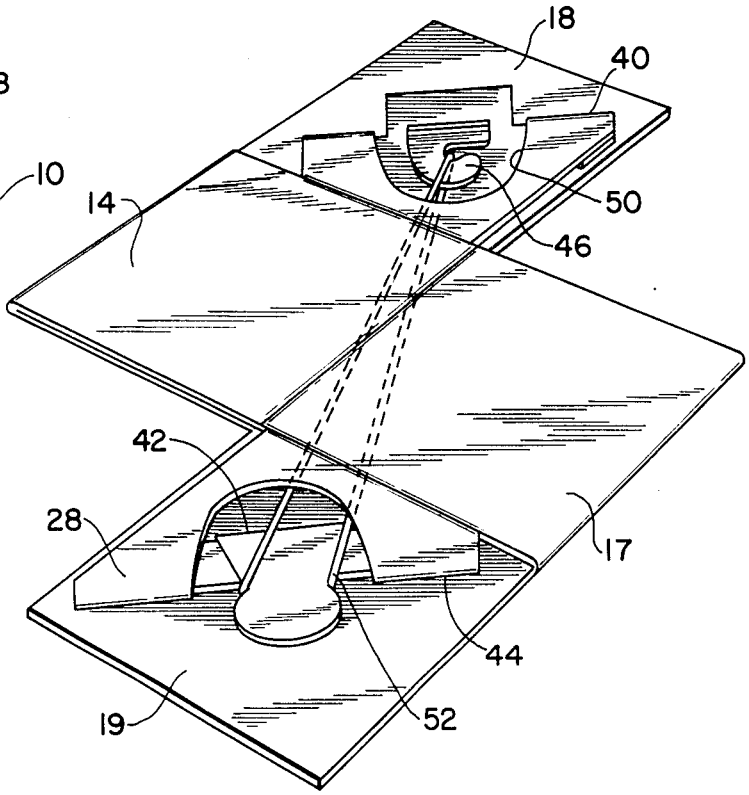
FIG. 2 is a perspective view of the hollow structure of FIG. 1 collapsed flat.
Figure 3:
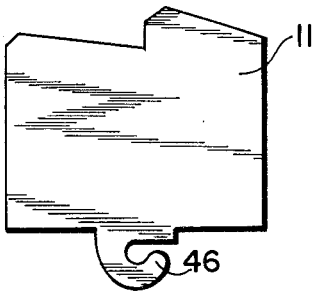
FIG. 3 is a plan view of the copy extender affixed to the hollow structure.
Figure 4:
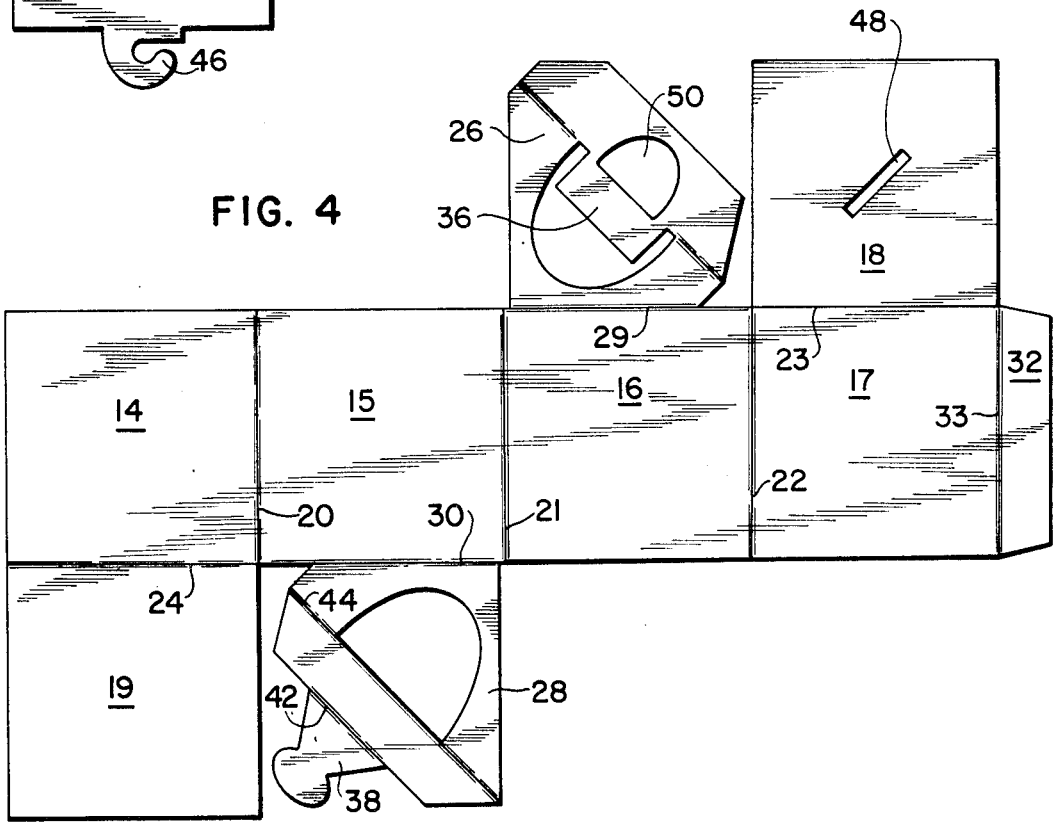
FIG. 4 is a plan view of the blank from which the cube shaped hollow structure is formed.

In forming the cube 10, the blank 12 is first reversely folded along the score line 22 so that the side wall 17 lies atop the side wall 16. An adhesive then is affixed to the exposed side of the glue flap 32 and, thereafter, the blank 12 is reversely folded along the score line 20 so that the side wall 14 lies atop the side wall 15 and the glue flap 32. Next, the flap 26 is reversely folded along the score line 40 and the attachment 36 is affixed to the end wall 18, by means of adhesive, staples or the like. The flap 28 likewise is reversely folded first along the score line 42 and then again along the score line 44. The attachment 38 then is affixed to the end wall 19 by means of an adhesive, staples, or the like. Normally, the flap 26 would be identical to the flap 28, however, in the illustrated embodiment, the cube 10 is adapted to receive the copy extender 11. The copy extender 11, as illustrated in FIG. 3, is simply a flat sheet of paperboard material having a hook portion 46 formed thereon, otherwise the copy extender can assume virtually any shape or configuration. In order to adapt the copy extender 11 to the cube 10, the end wall 18 has a slot 48 formed therein for receiving therethrough hook portion 46 of the copy extender 11. The copy extender 11, in this case, is extended through the slot 48 in the end wall 18 and through the aperture 50 in the attachment portion 36 of the flap 26, as can be best seen in FIG. 2. Next, an elastic band 52 is fixed about the attachment 38 of the flap 28, extended beneath the collapsed side walls, and its opposite end affixed about the hook portion 46 of the copy extender 11, all as illustrated in FIG. 2. The elastic band 52 is, of course, stretched and therefore under tension.

Upon completion of the formation of the cube 10, with the copy extender 11 attached thereto, it lies flat as illustrated in FIG. 2. However, since the elastic band 52 is under tension, it tends to pull the side walls 18 and 19 towards one another and, if the cube 10 is not held in its flattened position as illustrated in FIG. 2, the action is such that the cube 10 is self-erecting into a hollow structure, in this case, a cube 10, as illustrated in FIG. 1. Also, when erected, the copy extender 11 is pulled to an upright position, perpendicular to the end wall 18 of the cube 10, as illustrated.

Figure 5:
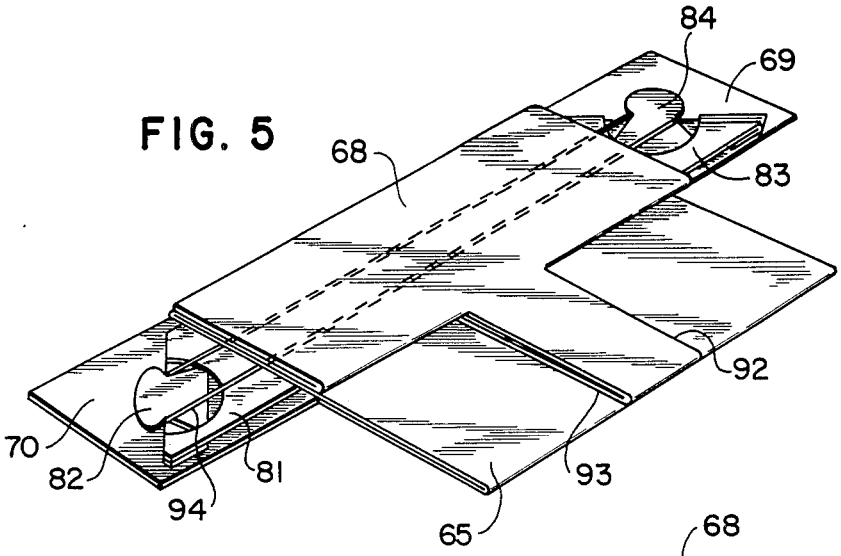
FIG. 5 is a perspective view of a hollow structure in the form of a rectangle, with a copy extender integrally formed therewith, in its collapsed condition.
Figure 6:
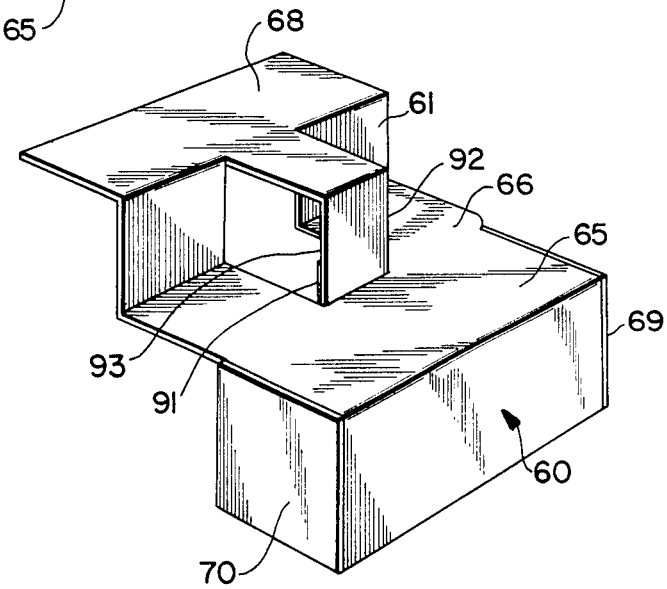
FIG. 6 is a perspective view of the hollow structure of FIG. 5 erected.
Figure 7:
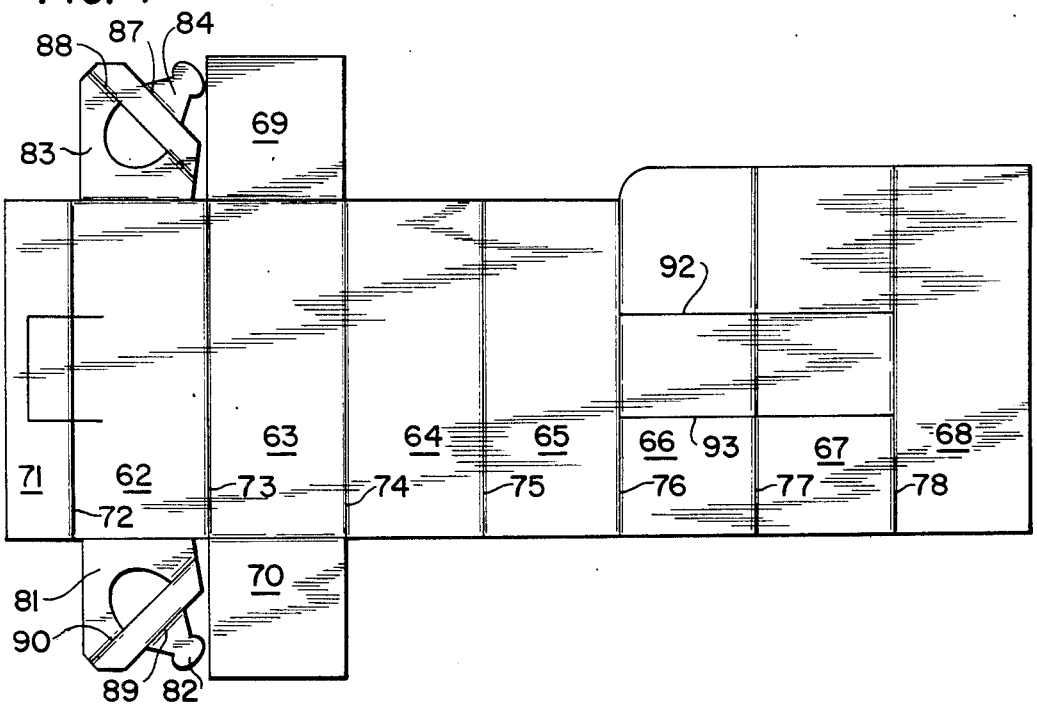
FIG. 7 is a plan view of the blank from which the hollow structure of FIGS. 5 and 6 is formed.

In FIGS. 5–7, there is illustrated still another self-erecting hollow structure which is basically in the form of a rectangle 60, but has a copy extender portion 61 integrally formed with it. The hollow structure is formed from the integral blank of paperboard illustrated in FIG. 7, and the rectangle 60 portion thereof is formed by the side walls 62–65 and the end walls 69–70. Each of the walls 62–65 and 69, 70 is hingedly connected along at least one edge thereof to at least one of the other walls. The hinge connections between these walls are formed by the respective ones of the score lines 72–75 and 79, 80. The rectangle 60 also has at least two flaps 81 and 83, each of which is hingedly connected along one edge thereof with one of the side walls 62–65. As illustrated, the flap 81 is hingedly connected by the score line 85 to the side wall 62, and the flap 83 is hingedly connected by the score line 86 to the same side wall 62. A glue flap 71 also is hingedly connected by the score line 72 to the side wall 62. The flaps 81 and 83 each is cut and scored to form an attachment 82, 84 for affixing these flaps 81 and 83 to one of the end walls 69, 70, as more particularly described below. A u-shaped cut line 91 is formed in the glue flap 71 and the side wall 62, for reasons which will be apparent from the description below.

The hollow structure can be simply the rectangle 60, with the latter being formed from the blank described above, however, as illustrated, a copy extender portion 61 is integrally formed with it. The copy extender portion 61 is formed generally by the walls 66–68 which are hingedly connected to the rectangle 60 by the score line 76. The walls 66–68 are defined by the score line 66–68. Two parallel, spaced-apart cut lines 92, 93 are formed in the walls 66, 67 and extend between the score lines 66, 67 and function to form the copy extender portion 61, all as more specifically described below.

In forming the rectangle 60 and the copy extender portion 61, the blank first is reversely folded along the score line 73 so that the side wall 62 lies atop the side wall 63. Thereafter, the flap 81 is first reversely folded along the score line 89 and the along the score line 90, and then the attachment 82 fixedly secured by means of adhesive, staples or the like to the end wall 70. Correspondingly, the flap 83 is first reversely folded along the score line 87 and then along the score line 88, and the attachment 83 then fixedly secured by means of adhesive, staples or the like to the end wall 69. Adhesive is applied to the glue flap 71, except for that portion of the glue flap defined by the u-shaped cut line 91 that extends from the score line 72. The blank then is folded in an accordian fashion along the score line 77 and 78 such that the wall 67 is sandwiched between the walls 66 and 68. At the same time, that portion of the walls 76, 77 defined by the cut line 92, 93 is folded in the opposite direction along the score line 77 (which would be downwardly as seen in FIG. 7), such that the folded portions abutt together and lie against the wall 65. Next, the blank is reversely folded along the score line 75 and when folded flat the glue flap 71 is adhesively secured to the side wall 65. Simultaneously, when making this fold, adhesive is applied to the backside of that portion of the glue flap 71 defined by the u-shaped cut line 91, and that portion of the glue flap is extended through the opening in the wall 66 formed by the cut lines 92, 93 and is adhesively affixed to that portion of the wall 66 defined by the cut line 92, 93. At this time, the folded blank is an illustrated in FIG. 5, and an elastic band 94 is secured about the attachment 82, extended between the folded side walls, and attached to the attachment 84.

The elastic band 94 is stretched and is under tension, so that it tends to pull the end walls 69 and 70 towards one another which action will cause the rectangle 60 to self-erect and, at the same time, to erect the copy extender portion 62, all as illustrated in FIG. 6.

Figure 8:
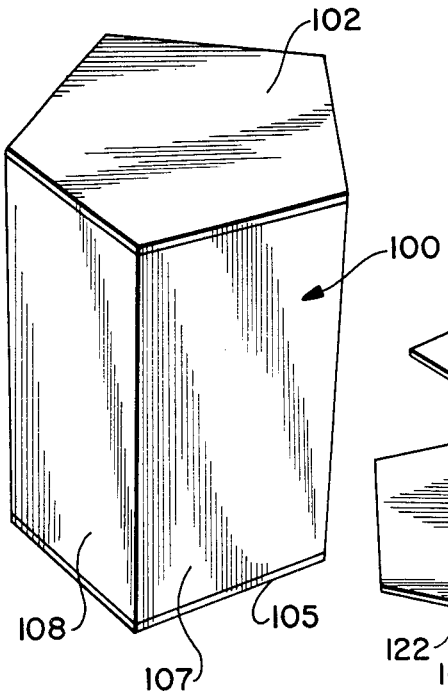
FIG. 8 is a perspective view of a hollow structure in the form of a pentagon.
Figure 9:
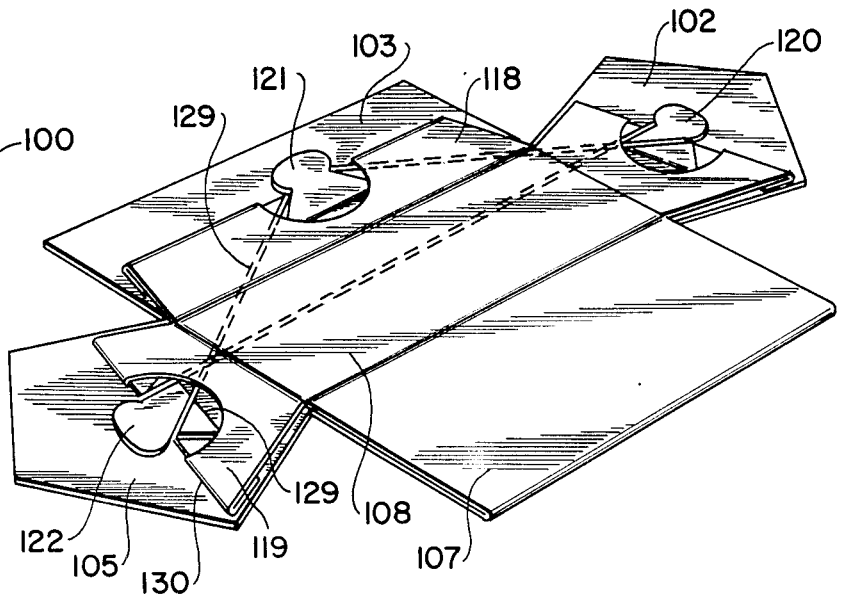
FIG. 9 is a perspective view of the hollow structure of FIG. 8 in its collapsed condition.
Figure 10:
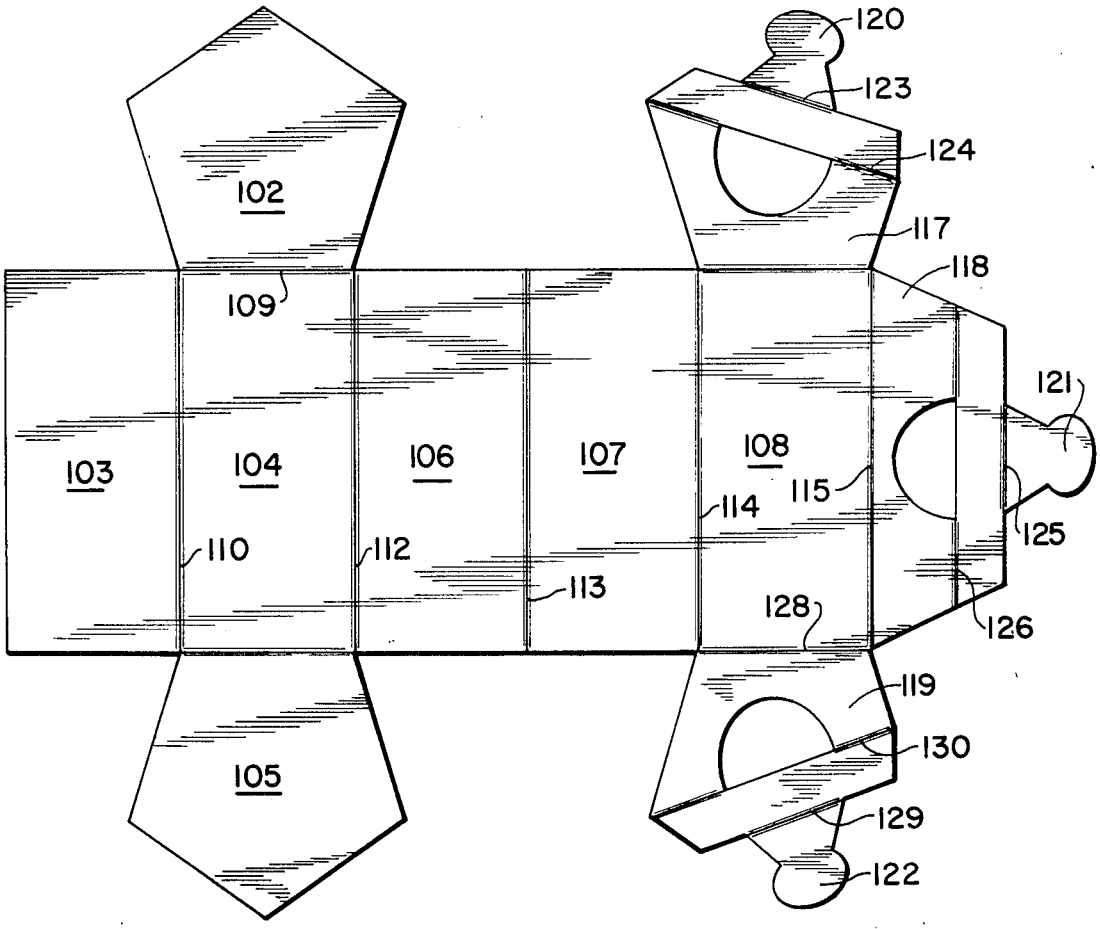
FIG. 10 is a plan view of the blank from which the hollow structure of FIGS. 8 and 9 is formed.

In FIGS. 8–10 there is illustrated another self-erecting hollow structure which is in the form of a pentagon 100. The pentagon 100 is formed from the integral blank of paperboard 101 illustrated in FIG. 10, and includes side walls 103–108 and end walls 102, 105. Each of the walls 102–108 is hingedly connected along one edge thereof to at least one of the other walls. The hinge connections between these walls are formed by the respective ones of the score lines 109–115. The pentagon 100 also has three flaps 117–119, each of which is hingedly connected along one edge thereof with at least one of side walls. As illustrated, the flap 117 is hingedly connected to the side wall 108 by means of the score line 127 and the flap 119 is hingedly connected to the side wall 108 by means of the score line 128. The flaps 117–119 each is cut and scored to form an attachment 120–122 for affixing these flaps 117–119 to one of the end walls 102, 105, as more particularly described below.

In forming the pentagon 100, the flap 118 of the blank 101 first is reversely folded along the score line 125 and then along the score line 126. The blank then is reversely folded along the score line 114 so that the side walls 108 and 107 lie atop the side walls 104 and 106, respectively. When folded in this fashion, the flap 118 will overlie approximately one-half of the side wall 103, and the attachment 121 then is fixedly secured by means of adhesive, staples, or the like to the side wall 103. The flap 117 next is reversely folded along the score line 123 and then the score line 124 and the attachment 120 then fixedly secured by means of adhesive, staples or the like, to the end wall 102. Correspondingly, the flap 119 is reversely folded along the score line 129 and the score line 130, and the attachment 122 fixedly secured by means of adhesive, staples or the like to the end wall 105. The pentagon when folded in this fashion, lies flat, as illustrated in FIG. 9, and an elastic band 129, such as a rubber band now is connected to the attachment 122, extended beneath the folded side walls and about the attachments 120 and 122, as illustrated in FIG. 9.

The elastic band 129 is stretched and under tension. As a result, the elastic band 129 naturally tends to pull the end walls 102, 105 towards one another and simultaneously the side wall 103 between the end wall 102, 105. The resulting action is such that the hollow structure is self-erecting to form the pentagon 100, as illustrated in FIG. 1.

The hollow structures defined by the cube 10, the rectangle 60 and the pentagon 100, with or without the copy extenders 11 and 61 affixed to or integral formed with them, can be used for a multiplicity of purposes such as toys, greeting cards, advertising devices and the like. In particular, as a toy, appropriate indicia can be applied to the respective ones of the side and end walls thereof to adapt the hollow structure to this purpose. Likewise, for example, indicia in the form of a greeting can be applied to the respective one of the side and end walls of the hollow structures. It then can be shipped flat in a suitable shipping envelope, and when removed from the shipping envelope, will self-erect to display the greeting. As an advertising device, it can be similarly formed, and shipped. The copy extenders 11 and 61 provide additional space for indicia to be added to the basic hollow structure and, in addition, can be suitably shaped or formed to provide a unique speciality, personalized or attractive addition to the hollow structure.

Each of the disclosed hollow structures can be easily collapsed after being erected, by grasping the end walls to which the attachments retaining the elastic band are affixed, and then spreading the end walls apart while simultaneously folding the side walls back to the flatten positions.

It may be noted that end walls, as well as the side walls, forming the hollow structures all are solid, rigid, one-piece walls which completely enclose the end and sides of the hollow structures so that the walls do not detract from the appearance of the hollow structures. Further still, the construction is such that the elastic bands which self-erect the hollow structures are fully concealed by these walls within the hollow structures when the latter are erected. The elastic bands thus do not detract from the appearance of the hollow structures. Further still, the action is such that the hollow structures self-erect so quickly that it is not readily apparent how they self-erect. With the elastic bands being fully concealed when erect, it is not immediately apparent to those observing the hollow structures as to how they did self-erect.

While only three different shapes of the hollow structures are illustrated, a variety of other shapes, such as triangles, pyramids, hexagons, polyhedrons and variations thereof, likewise can be formed. Where the hollow structures have an even number of side walls, the hollow structures can be made to self-erect by affixing the attachments to two opposed end walls, with the fold or score line, such as the score lines 40, 42 and 44 of the flaps 26 and 28 of the cube 10 and the score line 87, 88, 89 and 90 of the flaps 81 and 83 of the rectangle 60, extending diagonally to the bisecting the end wall to which the flaps are affixed. In the case of the hollow structures having an odd number of side walls, such as the pentagon 100, the score lines such as the score line 123, 125, 129, 130 of the flaps 117, 119 which are affixed to the end walls 102, 105 extend diagonally from one corner and bisect the opposed edge of the end wall, and the flap such as the flap 118 which is attached to one of the side walls must be formed such that the score line defining the attachment extends parallel to the score lines defining the side wall and bisect the side walls.

What is claimed is:

1. A collapsible, self-erecting closed hollow structure which is formed from an integral blank of paperboard which is cut and scored to form a plurality of side and end walls which when erected form said closed hollow structure, each of said plurality of side and end walls being hingedly connected along one edge thereof with one at least one other wall;

at least two flaps, each of which is hingedly connected along one edge thereof with at least one of said plurality of side walls, each of said flaps being cut and scored to form an attachment and further being folded and affixed to one of said plurality of end walls on the side thereof which is interior of the closed erected hollow structure, and elastic means secured under tension to said attachments, said elastic means normally pulling said two end walls to which said flaps are hingedly connected toward one another and thereby erecting said closed hollow structure.

2. The collapsible, self-erecting closed hollow structure of claim 1, further comprising a copy extender affixed thereto, one of said end walls having a slot formed therein, said copy extender having a hook portion proportioned to extend through said slot in said end wall, said elastic means being secured under tension to one of said attachments and to said hook portion, whereby said closed hollow structure is erected and said copy extender positioned substantially perpendicular to said end wall by the action of said elastic means.

3. The collapsible, self-erecting closed hollow structure of claim 1, further comprising a copy extender integrally formed therewith and simultaneously erected with the erection of said closed hollow structure.

4. The collapsible, self-erecting closed hollow structure of claim 1, comprising an even number of side walls, said closed hollow structure having two flaps which are affixed to two opposed end walls, and said attachments thereon being folded along score lines which extend diagonally across and bisect the end flap to which they are affixed.

5. The collapsible, self-erecting closed hollow structure of claim 1, comprising an odd number of side walls, said closed hollow structure having two flaps which are affixed to two opposed end walls and said attachments thereon being folded along score lines which extend diagonally from one corner of said end flap and bisect the opposed edge of said end flap, and one flap which is affixed to one side wall and said attachment thereon being folded along a score line which bisects said side wall.

6. The collapsible, self-erecting closed hollow structure of claim 1, wherein said elastic means is totally concealed within the interior of the erected closed hollow structure.

7. The collapsible, self-erecting closed hollow structure of claim 1, wherein said end walls are solid, rigid, one-piece walls which completely close the ends of the erected closed hollow structure.

* * * * *